US008487721B2

(12) United States Patent
Madamshetty

(10) Patent No.: US 8,487,721 B2
(45) Date of Patent: Jul. 16, 2013

(54) CIRCUIT INTERRUPTION DEVICE AND METHOD OF ASSEMBLY

(75) Inventor: Praneeth Kumar Madamshetty, Andhra Pradesh (IN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 12/985,909

(22) Filed: Jan. 6, 2011

(65) Prior Publication Data

US 2012/0176210 A1 Jul. 12, 2012

(51) Int. Cl.
*H01H 9/44* (2006.01)
*H01H 33/18* (2006.01)

(52) U.S. Cl.
USPC ..... 335/16; 335/6; 335/15; 218/22; 218/30

(58) Field of Classification Search
USPC ..... 335/16, 6, 15; 218/22–42
See application file for complete search history.

(56) References Cited

U.S. PATENT DOCUMENTS

| | | | |
|---|---|---|---|
| 2,424,298 A | 7/1947 | Bailey | |
| 2,537,080 A | 1/1951 | O'Brien et al. | |
| 3,500,266 A | 3/1970 | De Torre | |
| 4,654,490 A | 3/1987 | Leone et al. | |
| 4,910,485 A * | 3/1990 | Bolongeat-Mobleu et al. | 335/195 |
| 6,373,014 B1 * | 4/2002 | Mitsuhashi et al. | 218/22 |
| 6,774,749 B2 | 8/2004 | Raabe et al. | |

FOREIGN PATENT DOCUMENTS

EP 1069584 A1 1/2001

OTHER PUBLICATIONS

Search Report and Written Opinion from corresponding EP Application No. 12150205.8 dated Apr. 26, 2012.

* cited by examiner

*Primary Examiner* — Ramon Barrera
(74) *Attorney, Agent, or Firm* — Global Patent Operation

(57) ABSTRACT

A circuit interruption device includes a conductive element configured to be coupled to a circuit, a contact arm configured to move with respect to the conductive element between a first position and a second position, and a biasing element configured to apply a biasing force on the contact arm to maintain contact between the contact arm and the conductive element when the contact arm is in the first position, wherein the contact arm is configured such that a current flow through the contact arm causes an electromagnetic repulsive force to act on the contact arm in a second direction that is opposite the first direction.

19 Claims, 6 Drawing Sheets

CIRCUIT INTERRUPTION DEVICE AND METHOD OF ASSEMBLY

BACKGROUND OF THE INVENTION

The embodiments described herein relate generally to circuit protection devices and, more particularly, to circuit interruption devices.

At least some known circuit protection devices include a stationary contact arm and one or more movable contact arms. During normal operations, the stationary and movable contact arms are maintained in contact to enable current to flow through the circuit protection device. However, when a current condition, such as a short circuit or current spike, is detected, the circuit protection device causes the movable contact arm to move away from the stationary contact arm to prevent current from flowing therebetween. Moreover, at least some known movable contact arms are shaped to guide current flow from the movable contact arm into the stationary contact arm. For example, at least some known movable contact arms are shaped such that a current path between the movable contact arm and the stationary contact arm is a substantially straight path.

BRIEF DESCRIPTION OF THE INVENTION

In one aspect, a circuit interruption device includes a conductive element configured to be coupled to a circuit, a contact arm configured to move with respect to the conductive element between a first position and a second position, and a biasing element configured to apply a biasing force on the contact arm to maintain contact between the contact arm and the conductive element when the contact arm is in the first position, wherein the contact arm is configured such that a current flow through the contact arm causes an electromagnetic repulsive force to act on the contact arm in a second direction that is opposite the first direction.

In another aspect, a trip mechanism is provided for use with a circuit breaker, wherein the trip mechanism includes a conductive element configured to be coupled to a circuit, and a contact arm configured to move with respect to the conductive element between a first position and a second position. The contact arm is configured such that a current flow through the contact arm causes an electromagnetic repulsive force to act on the contact arm in the second direction.

In another aspect, a method of assembling a circuit breaker includes coupling a conductive element to a circuit, positioning a contact arm with respect to the conductive element, and coupling a biasing element to the contact arm. The biasing element is configured to apply a biasing force on the contact arm in a first direction to maintain contact between the contact arm and the conductive element when the contact arm is in the first position. The contact arm is configured such that a current flow through the contact arm causes an electromagnetic repulsive force to act on the contact arm in a second direction that is opposite the first direction.

DETAILED DESCRIPTION OF THE INVENTION

Exemplary embodiments of apparatus for use with circuit interruption devices and methods of assembling circuit interruption devices are described herein. These embodiments facilitate enhancing circuit interruption device performance by changing a direction of current flow. Changing the direction of current flow enables faster response to abnormal current conditions and faster mitigation of electrical arcs caused by separation of the electrical contacts within the circuit interruption device. For example, the response to abnormal current conditions is enhanced by providing a greater repulsive force between the electrical contacts to overcome a biasing force that maintains contact between the electrical contacts. This reduces the clearing time for the circuit interruption device to fully open or trip. Moreover, an electrical arc is extinguished faster due to an additional propulsive force that causes the energy of the electrical arc to move into an arc chute comprised of a plurality of arc mitigation plates.

Figure 1:
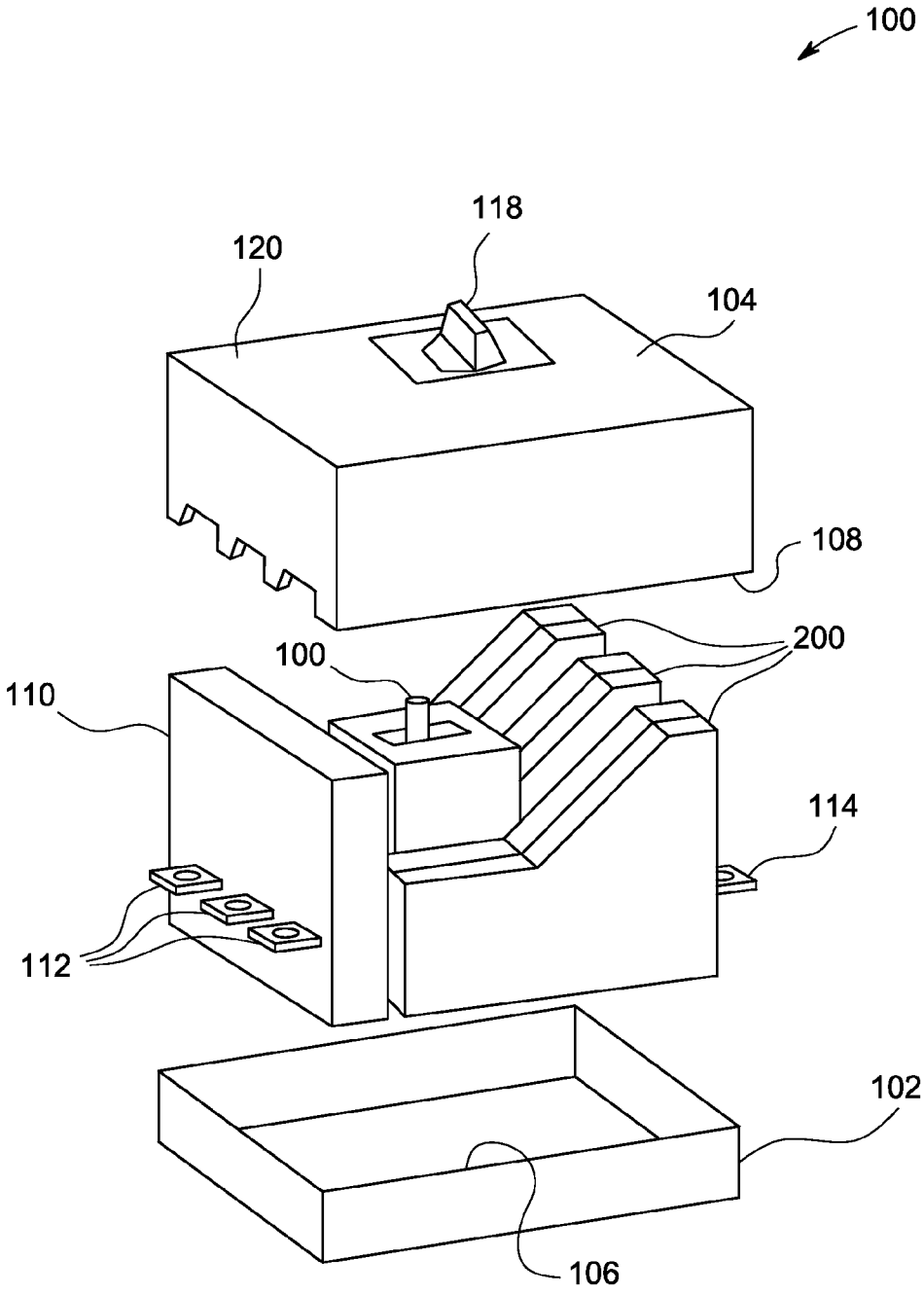
FIG. 1 is an exploded view of an exemplary circuit interruption device.

FIG. 1 is an exploded view of an exemplary circuit interruption device 100, such as a circuit breaker. In an exemplary embodiment, circuit interruption device 100 includes a base 102 and a cover 104 that couples to base 102. For example, base 102 includes a top edge 106 and cover 104 includes a bottom edge 108 sized to couple to top edge 106 and form a housing. Circuit interruption device 100 also includes one or more trip mechanisms 200 and a relay 110. Although FIG. 1 shows three trip mechanisms 200 within circuit interruption device 100, it should be understood that more or fewer trip mechanisms 200 may be used with circuit interruption device 100. In an exemplary embodiment, relay 110 detects an abnormal current condition, such as an overcurrent or short circuit condition, through a circuit (not shown) that connects a power source to a load. Specifically, a portion of the circuit is coupled to one or more input terminals 112 that each corresponds to a respective trip mechanism 200. Moreover, a portion of the circuit is coupled to one or more output terminals 114 that each corresponds to a respective trip mechanism 200. For example, in one embodiment, the circuit includes a plurality of conductors, such as a line conductor, a neutral conductor, and a ground conductor, each of which is coupled to a respective input terminal 112 on the line side of circuit interruption device 100 and to a respective output terminal 114 on the load side of circuit interruption device 100. In an exemplary embodiment, circuit interruption device 100 also includes a means of manually opening electrical contacts within each trip mechanism 200. For example, as shown in FIG. 1 circuit interruption device 100 includes an opening mechanism 116 and a handle 118. Opening mechanism 116 is coupled to one or more of trip mechanisms 200 and is oriented to engage handle 118 and receive a user input. Handle 118 extends through a top surface 120 of cover 104 to be externally accessible to a user.

Figure 2:
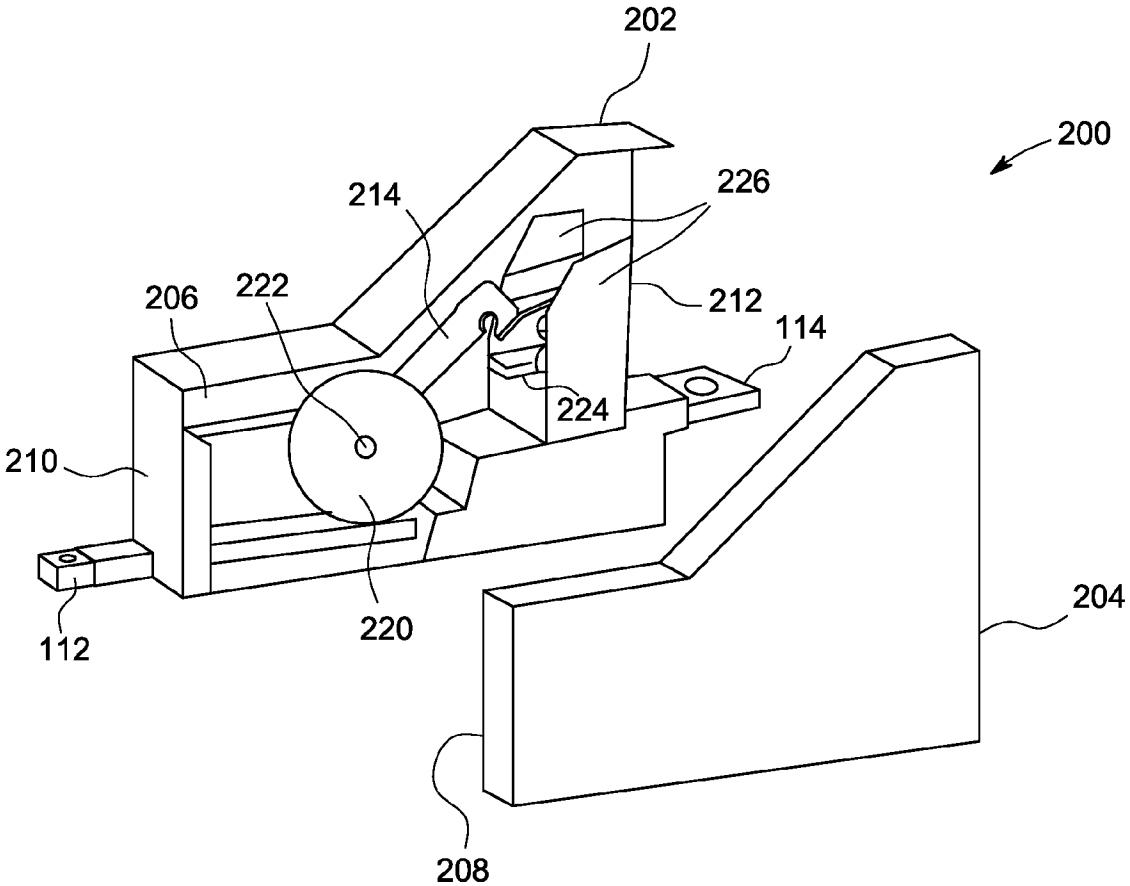
FIG. 2 is an exploded view of an exemplary trip mechanism that may be used with the circuit interruption device shown in FIG. 1.
Figure 3:
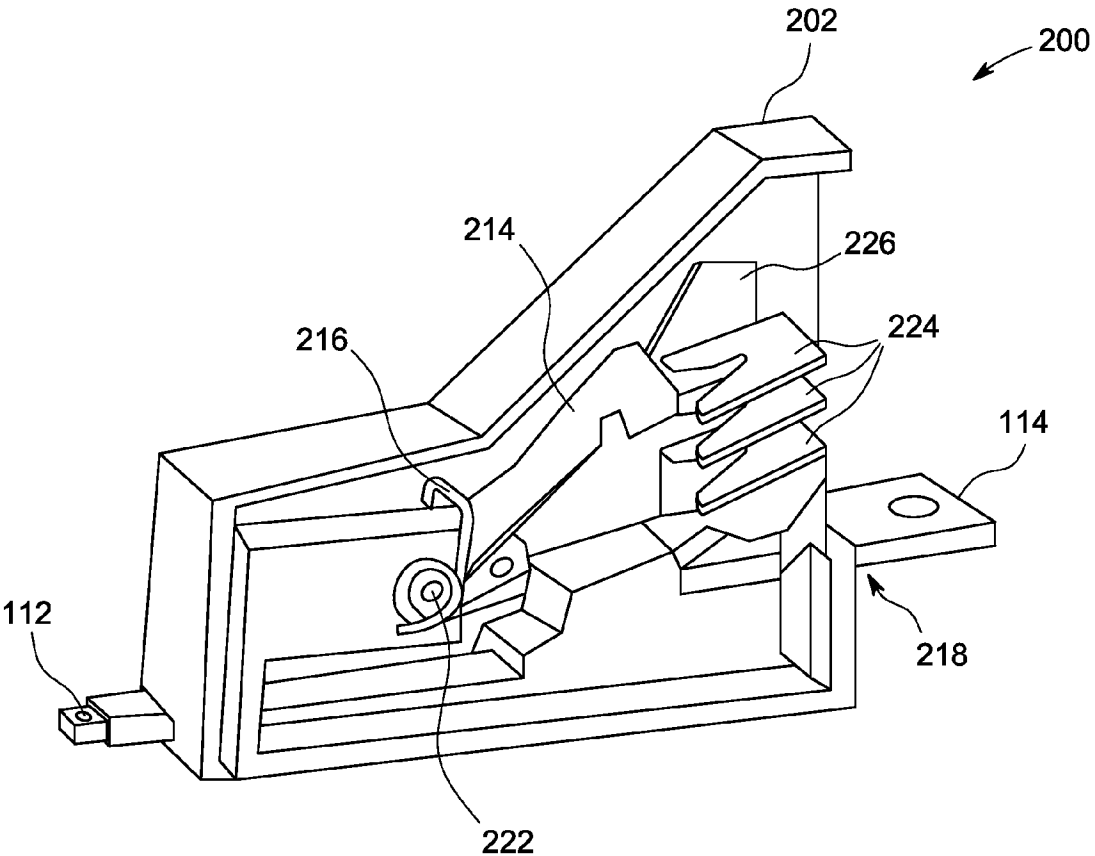
FIG. 3 is a cross-sectional view of the trip mechanism shown in FIG. 2.

FIGS. 2 and 3 are views of an exemplary trip mechanism 200 for use with circuit interruption device 100 (shown in FIG. 1). Specifically, FIG. 2 is an exploded view of trip mechanism 200 and FIG. 3 is a cross-sectional view of trip mechanism 200. As shown in FIG. 2, trip mechanism 200 includes a housing having a first housing portion 202 and a second housing portion 204. Housing portions 202 and 204 include a first inner edge 206 and a second inner edge 208, respectively, and housing portions 202 and 204 are coupled together along inner edges 206 and 208. Input terminal 112 extends through a front surface 210 of first housing portion 202. Similarly, output terminal 114 extends through a rear surface 212 of first housing portion 202.

In an exemplary embodiment, trip mechanism 200 includes a contact arm 214 coupled to a biasing element 216, such as a spring. Trip mechanism 200 also includes a conductive element 218, such as a line strap. Biasing element 216 is positioned within a biasing element enclosure 220 and causes contact arm 214 to rotate about a shaft 222 between a first position, such as a closed position, and a second position, such as an open position. As described in detail below, a portion of contact arm 214 contacts a portion of conductive element 218 when contact arm 214 is in the first position to enable current to flow from contact arm 214 to conductive element 218. Moreover, biasing element 216 applies a biasing force to contact arm 214 in a first direction (not shown in FIGS. 2 and 3) to maintain contact arm 214 in the first position. When contact arm 214 is in the second position, contact arm 214 and conductive element 218 are not in contact, thereby preventing current from flowing through contact arm 214 to conductive element 218.

When an abnormal current condition occurs, such as an overcurrent, contact arm 214 separates from conductive element 218 due to an electromagnetic repulsive force generated in a second direction (not shown in FIGS. 2 and 3) that is opposite the first direction. The repulsive force is generated between contact arm 214 and conductive element 218 based on a current flow through contact arm 214, as set forth below, such that when the current flow causes the repulsive force to exceed the biasing force, contact arm 214 separates from conductive element 218. The electromagnetic repulsive force between contact arm 214 and conductive element 218 also generates an electric arc. In an exemplary embodiment, trip mechanism 200 also includes a plurality of arc mitigation plates 224 that are positioned within an arc enclosure 226 to form an arc chute. Arc mitigation plates 224 and arc enclosure 226 are oriented within first and second housing portions 202 and 204 such that the energy of the arc is absorbed and/or dissipated by arc mitigation plates 224.

Figure 4:
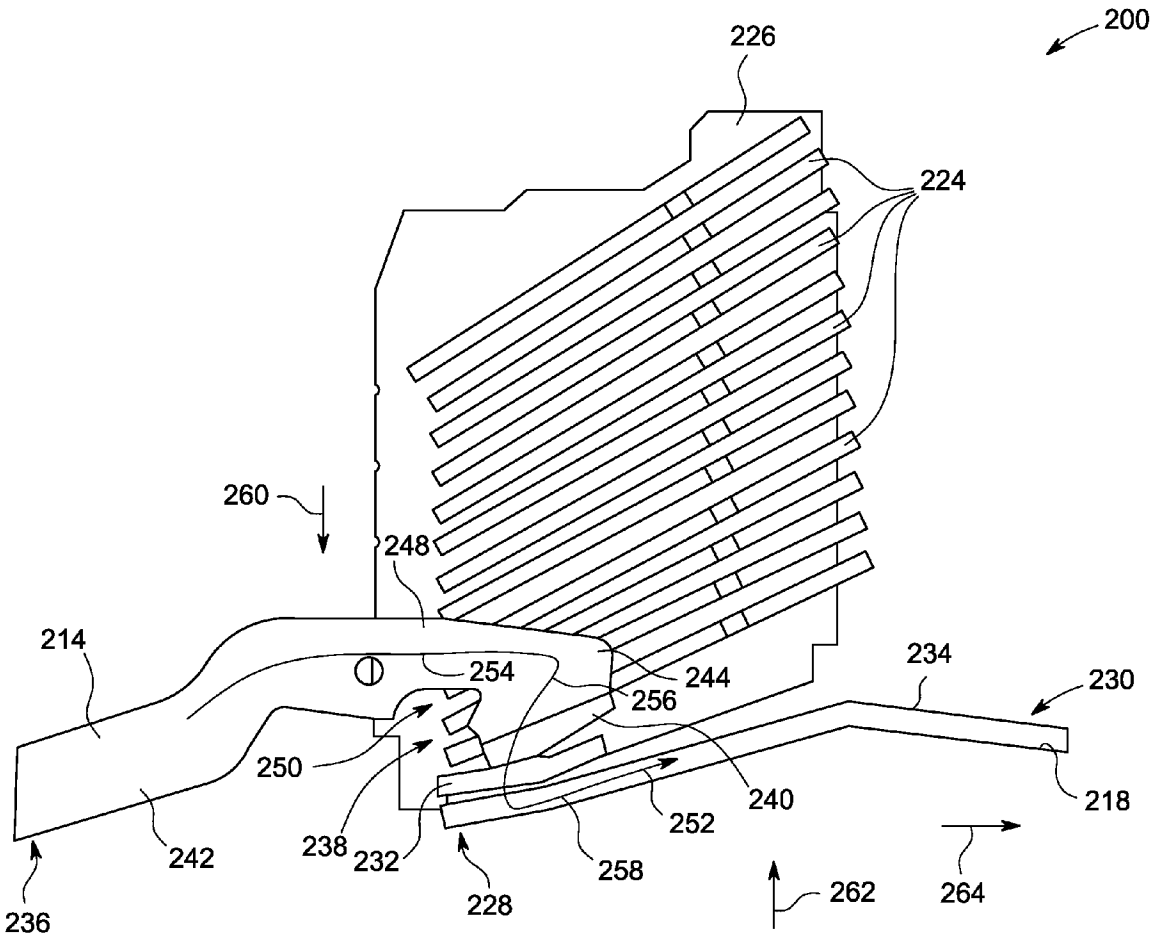
FIG. 4 is a partial side view of a portion of the trip mechanism shown in FIG. 2.
Figure 5:
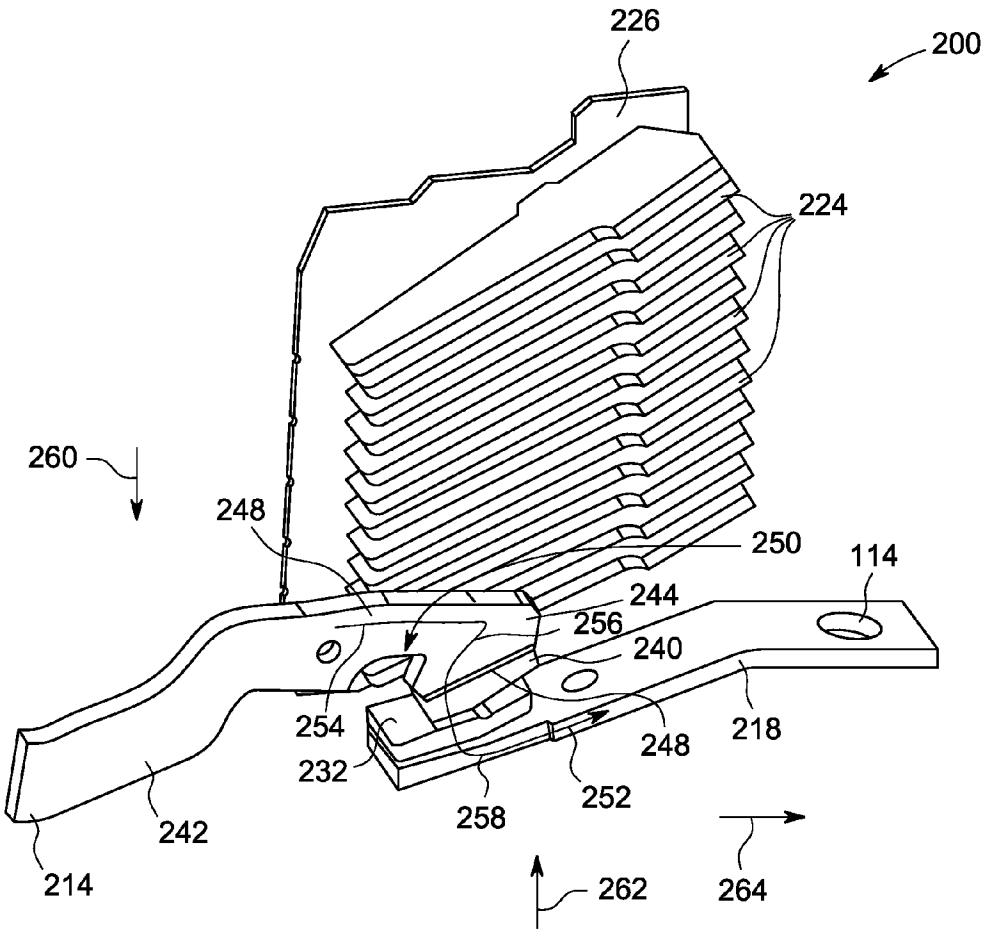
FIG. 5 is a partial perspective view of a portion of the trip mechanism shown in FIG. 2.

FIGS. 4 and 5 are partial views of a portion of trip mechanism 200. Specifically, FIG. 4 is a partial side view of a portion of trip mechanism 200, and FIG. 5 is a partial perspective view of a portion of trip mechanism 200. In an exemplary embodiment, conductive element 218 includes a first end 228 and an opposite second end 230. A first electrical contact 232 is provided along a portion of a top surface 234 of conductive element 218 at first end 228. Output terminal 114 is provided at second end 230.

Figure 6:
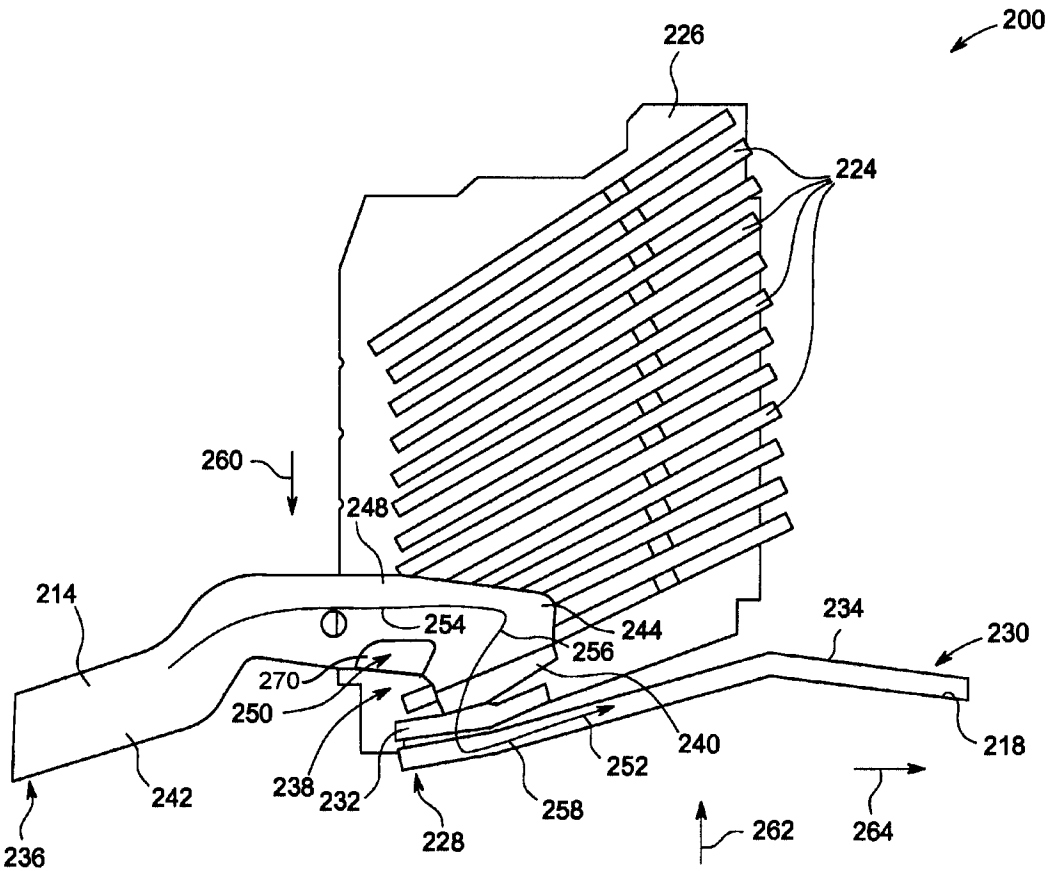
FIG. 6 is a partial side view of a portion of an alternative trip mechanism.

Moreover, in an exemplary embodiment, contact arm 214 includes a first end 236 and an opposite second end 238. First end 236 is coupled to input terminal 112 (shown in FIGS. 1-3). A second electrical contact 240 is provided at second end 238. Contact arm 214 includes a first portion, such as a body portion 242, extending from first end 236 towards second end 238. Contact arm 214 also includes a second portion, such as a head portion 244, at second end 238. Second electrical contact 240 is provided along a bottom surface 246 of head portion 244 to enable electrical contact between contact arm 214 and conductive element 218. Moreover, head portion 244 facilitates causing current flowing through contact arm 214 to change direction within head portion 244 and prior to flowing to conductive element 218. Furthermore, contact arm 214 includes a third portion, such as a neck portion 248, which is provided between body portion 242 and head portion 244. In one embodiment, neck portion 248 defines a notch 250. In one embodiment, notch 250 is formed by removing material from neck portion 248. In another embodiment, shown in FIG. 6, notch 250 is composed of an insulating material 270 and the remainder of neck portion 248 is composed of a conductive material. In an exemplary embodiment, neck portion 248 is formed to facilitate causing a current flow through head portion 244 to change direction, which can cause contact arm 214 to separate from conductive element 218 when the amplitude of the current flow is greater than or equal to a threshold value.

In an exemplary embodiment, contact arm 214 and conductive element 218 define an electrical path 252 for current. Electrical path 252 includes a first portion 254 in which the current flows through body portion 242 and neck portion 248. Electrical path 252 also includes a second portion 256 in which the current changes direction within head portion 244. Electrical path 252 also includes a third portion 258 in which the current again changes direction. Specifically, the current flows through second electrical contact 240 and into first electrical contact 232, where the direction of current flow changes in order to generate the repulsive force.

For example, the changes in direction of the current flow generate an electromagnetic repulsive force between first and second electrical contacts 232 and 240. In an exemplary embodiment, the biasing force is applied in a first direction 260, and when the current is below a threshold level, the biasing force maintains contact between contact arm 214 and conductive element 218. However, when the current is greater than or equal to the threshold level, the repulsive force overcomes the biasing force. Specifically, the changes in direction of the current flow generates the repulsive force in a second direction 262 that is substantially opposite first direction 260, and that has an amplitude in second direction 262 that is greater than an amplitude of the biasing force in first direction 260. Accordingly, when the repulsive force in second direction 262 is greater than the biasing force in first direction 260, contact arm 214 moves in second direction 262 to break electrical contact with conductive element 218. For example, a first component of the repulsive force substantially occurs in second direction 262 that is opposite first direction 260, and a second component of the repulsive force substantially occurs in a third direction 264 that is substantially orthogonal to first direction 260 and second direction 262. When the amplitude or level of the current is greater than a threshold amplitude or level, the first component of the repulsive force becomes greater than the biasing force applied to contact arm 214 by biasing mechanism 216 (shown in FIG. 3). The first component of the repulsive force causes contact arm 214 to separate from conductive element 218, thereby preventing current from flowing through into conductive element 218. More specifically, the first component of the repulsive force causes second electrical contact 240 to move in second direction 262 to separate from first electrical contact 232. Moreover, the first component of the repulsive force causes formation of an electrical arc between first and second electrical contacts 232 and 240. The second component of the repulsive force propels the arc in third direction 264 towards the arc chute where the energy of the arc is dissipated by arc mitigation plates 224.

A method of assembling circuit interruption device 100, such as a circuit breaker, includes coupling conductive element 218 to a circuit, and positioning contact arm 214 with respect to conductive element 218. In an exemplary embodiment, contact arm 214 moves with respect to conductive element 218 between a first position and a second position. The method also includes positioning at least one arc mitigation plate 224 above at least a portion of conductive element 218 such that arc mitigation plate 224 extinguishes an arc created by a separation of contact arm 214 from conductive element 218 when contact arm 214 moves from the first position to the second position.

The method further includes providing contact arm 214, including body portion 242, head portion 244, and neck portion 248 positioned between body portion 242 and head portion 244. Head portion 244 is configured to facilitate changing the direction of current flow through head portion 244 to cause an electromagnetic force to act on contact arm 214 in second direction 262. In some embodiments, when contact arm 214 is in the first position, electrical path 252 is defined. Electrical path 252 includes first portion 254 in which current flows through body portion 242 and neck portion 248, and second portion 256 in which the current changes direction. Electrical path 252 also includes third portion 258 in which the current flows into conductive element 218 and then changes to generate the repulsive force.

Moreover, in some embodiments, the method of assembly also includes coupling biasing element 216 to contact arm 214. Biasing element 216 applies a biasing force on contact arm 214 in first direction 260 to maintain contact between contact arm 214 and conductive element 218 when contact arm 214 is in the first position.

Exemplary embodiments of apparatus and methods of assembling apparatus for use in circuit protection are described above in detail. The apparatus and methods are not limited to the specific embodiments described herein but, rather, operations of the methods and/or components of the apparatus may be utilized independently and separately from other operations and/or components described herein. Further, the described operations and/or components may also be defined in, or used in combination with, other systems, methods, and/or apparatus, and are not limited to practice with only the systems, methods, and storage media as described herein.

Although the present invention is described in connection with an exemplary electrical equipment protection environment, embodiments of the invention are operational with numerous other general purpose or special purpose equipment protection environments or configurations. The equipment protection environment is not intended to suggest any limitation as to the scope of use or functionality of any aspect of the invention. Moreover, the environment described herein should not be interpreted as having any dependency or requirement relating to any one or combination of components illustrated in the exemplary operating environment.

The order of execution or performance of the operations in the embodiments of the invention illustrated and described herein is not essential, unless otherwise specified. That is, the operations may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

When introducing elements of aspects of the invention or embodiments thereof, the articles "a," "an," "the," and "said" are intended to mean that there are one or more of the elements. The terms "comprising," including," and "having" are intended to be inclusive and mean that there may be additional elements other than the listed elements.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A circuit interruption device comprising:

a conductive element comprising a first end, said conductive element configured to be coupled to a circuit;

a contact arm comprising a first portion, a second portion, and a third portion, wherein at least a portion of said third portion is filled with a nonconductive material, said third portion defining a notch opening toward said conductive element, said contact arm further comprising a second end positioned to contact said conductive element first end such that said contact arm and said conductive element overlap only at said conductive element first end and said contact arm second end, said contact arm configured to move with respect to said conductive element between a first position and a second position; and a biasing element configured to apply a biasing force on said contact arm in a first direction to maintain contact between said contact arm and said conductive element when said contact arm is in the first position, said notch configured such that a current flow through said contact arm changes direction within said second portion prior to flowing to said conductive element and causes an electromagnetic repulsive force to act on said contact arm in a second direction that is opposite the first direction.

2. A circuit interruption device in accordance with claim 1, wherein said third portion is between said first portion and said second portion.

3. A circuit interruption device in accordance with claim 1, wherein the current flow through said second portion causes the repulsive force as the current flow exits said second portion and enters said conductive element.

4. A circuit interruption device in accordance with claim 1, wherein said third portion has a width less than a width of said first portion and a width of said second portion.

5. A circuit interruption device in accordance with claim 1, wherein when the current flow has a predetermined amplitude, the repulsive force caused by the current flow overcomes the biasing force to cause said contact arm to move in the second direction from the first position to the second position.

6. A circuit interruption device in accordance with claim 1, wherein said conductive element comprises a first electrical contact and said contact arm comprises a second electrical contact, said biasing element configured to apply the biasing force to said contact arm in the first direction to maintain contact between said first electrical contact and said second electrical contact when said contact arm is in the first position.

7. A circuit interruption device in accordance with claim 6, wherein the current flow through said contact arm causes the repulsive force in the second direction as the current flow exits said second electrical contact and enters said first electrical contact.

8. A circuit interruption device in accordance with claim 1, further comprising at least one arc mitigation plate positioned above at least a portion of said conductive element, said at least one arc mitigation plate configured to extinguish an arc created by a separation of said contact arm from said conductive element caused by the repulsive force.

9. A trip mechanism for use with a circuit breaker, said trip mechanism comprising:

a conductive element comprising a first end, said conductive element configured to be coupled to a circuit; and a contact arm comprising a first portion, a second portion, and a third portion, said third portion defining a notch opening toward said conductive element, said contact arm further comprising a second end positioned to contact said conductive element first end such that said contact arm and said conductive element overlap only at said conductive element first end and said contact arm second end, said contact arm configured to move with respect to said conductive element in a first direction and a second direction that is opposite the first direction, said notch configured such that a current flow through said contact arm changes direction within said second portion prior to flowing to said conductive element and causes an electromagnetic repulsive force to act on said contact arm in the second direction.

10. A trip mechanism in accordance with claim 9, wherein said third portion is between said first portion and said second portion.

11. A trip mechanism in accordance with claim 9, wherein the current flow through said second portion causes the repulsive force as the current flow exits said second portion and enters said conductive element.

12. A trip mechanism in accordance with claim 9, wherein said third portion has a width less than a width of said first portion and a width of said second portion.

13. A trip mechanism in accordance with claim 9, wherein said notch comprises a nonconductive material.

14. A trip mechanism in accordance with claim 9, wherein when the current flow has a predetermined amplitude, the repulsive force caused by the current flow overcomes the biasing force to cause said contact arm to move in the second direction from the first position to the second position.

15. A method of assembling a circuit breaker, comprising:

coupling a conductive element to a circuit, wherein the conductive element includes a first end;

positioning a contact arm with respect to the conductive element, wherein the contact arm includes a first portion, a second portion, and a third portion, the third portion defining a notch opening toward the conductive element, the contact arm further including a second end positioned to contact the conductive element first end such that the contact arm and the conductive element overlap only at the conductive element first end and the contact arm second end; and coupling a biasing element to the contact arm, the biasing element configured to apply a biasing force on the contact arm in a first direction to maintain contact between the contact arm and the conductive element when the contact arm is in the first position, the notch configured such that a current flow through the contact arm changes direction within said second portion prior to flowing to said conductive element and causes an electromagnetic repulsive force to act on the contact arm in a second direction that is opposite the first direction.

16. A method in accordance with claim 15, further comprising defining an electrical path such that, when the current flow is greater than a predetermined amplitude, the repulsive force caused by the current flow overcomes the biasing force to cause the contact arm to move in the second direction from the first position to the second position.

17. A method in accordance with claim 15, further comprising positioning at least one arc mitigation plate above at least a portion of the conductive element, the at least one arc mitigation plate configured to extinguish an arc created by a separation of the contact arm from the conductive element when the contact arm moves from the first position to the second position.

18. A method in accordance with claim 15, further comprising providing the contact arm, wherein the third portion is between the first portion and the second portion, the current flow through the second portion causes the repulsive force as the current flow exits the second portion and enters the conductive element.

19. A method in accordance with claim 15, wherein positioning the contact arm comprises positioning the contact arm having the notch formed from a nonconductive material.

* * * * *